United States Patent [19]

Miller et al.

[11] Patent Number: 5,068,028

[45] Date of Patent: Nov. 26, 1991

[54] MOLYBDENITE FLOTATION FROM COPPER SULFIDE/MOLYBDENITE CONTAINING MATERIALS BY OZONE CONDITIONING

[75] Inventors: Jan D. Miller; Yi Ye, both of Salt Lake City, Utah; Woo-Hyuk Jang, Seoul, Rep. of Korea

[73] Assignee: University of Utah, Salt Lake City, Utah

[21] Appl. No.: 485,959

[22] Filed: Jan. 21, 1990

[51] Int. Cl.[5] ..... B03D 1/002; B03D 1/02

[52] U.S. Cl. ..... 209/167; 209/166

[58] Field of Search ..... 209/166, 167; 252/61

[56] References Cited

U.S. PATENT DOCUMENTS

| | | | |
|---|---|---|---|
| 1,869,532 | 8/1932 | Weinig | 209/167 |
| 2,255,776 | 9/1941 | Janney | 209/166 |
| 2,559,104 | 7/1951 | Arbites | 209/167 |
| 3,102,854 | 9/1963 | Atwood | 209/167 |
| 3,137,649 | 6/1964 | DeBenedictis | 209/167 |
| 3,539,002 | 11/1970 | Last | 209/167 |
| 3,811,569 | 5/1974 | Shirley | 209/167 |

FOREIGN PATENT DOCUMENTS

| | | | |
|---|---|---|---|
| 16322 | 6/1970 | Japan | 209/166 |
| 109801 | 3/1977 | Japan | 209/166 |
| 87/00088 | 1/1987 | World Int. Prop. O. | 209/167 |

*Primary Examiner*—Stanley S. Silverman
*Assistant Examiner*—Thomas M. Lithgow
*Attorney, Agent, or Firm*—James L. Sonntag

[57] ABSTRACT

A process for recovering molybdenite from feed materials containing copper sulfide and molybdenite (e.g. copper/molybdenum concentrates from flotation processes) wherein the feed material is treated with ozone and then floated to recover molybdenite.

19 Claims, 6 Drawing Sheets

MOLYBDENITE FLOTATION FROM COPPER SULFIDE/MOLYBDENITE CONTAINING MATERIALS BY OZONE CONDITIONING

FIELD OF THE INVENTION

The present invention relates to the recovery of molybdenite from molybdenite-containing copper sulfide materials, such as copper/molybdenum concentrates produced from flotation of copper porphyry ores.

BACKGROUND OF THE INVENTION

Molybdenum is often a significant by-product from copper/molybdenum concentrates produced from the flotation of copper porphyry ores. In some instances the economic success of a copper mining operation depends upon recovery of molybdenum (in the form of molybdenite, $MoS_2$), as a byproduct from the concentrate.

Typically, copper porphyry ores contain molybdenite and one or more copper sulfide minerals, such as chalcopyrite ($CuFeS_2$), chalcocite ($Cu_2S$) and other copper sulfides. These ores are usually treated by a flotation process, wherein the ore is ground to free the copper sulfides and molybdenite from the surrounding rock. A suspension of the ground ore is sent to a flotation cell, where gas, usually air, is dispersed into the suspension to form bubbles. Particles with hydrophobic surfaces adhere to the surfaces of the bubbles and are carried to the surface of the suspension as a froth. The surfaces of copper sulfide minerals and molybdenite are made more hydrophobic from the addition of flotation reagents, eg. collector and frother reagents. Hence, the froth formed on the top of the suspension is a concentrate containing copper sulfides and molybdenite, which is then separated from most gangue minerals and recovered as a bulk copper/moly concentrate. Collector flotation reagents used to enhance hydrophobic surfaces on the copper sulfide minerals are typically sulfhydryl compounds, such as xanthates, dixanthogens, dithiophosphates, thionocarbamates, and xanthate ethylformate.

To separate the molybdenite from the copper sulfides, the bulk copper/moly concentrate is treated to depress the copper sulfides, i.e. to selectively change the surface properties of the copper sulfides such that they become more hydrophilic. After treatment, the bulk concentrate is again subjected to a flotation process in order to produce a concentrate of molybdenite. In this instance, particles of copper sulfide minerals which are depressed are not carried to the surface by the bubbles, whereas molybdenite particles, which have essentially retained their hydrophobic surfaces, are carried into the froth phase on the top of the suspension by the air bubbles, and are, thereby, separated from the copper sulfide mineral particles. Depression of the copper sulfide minerals is usually accomplished by chemical treatment using, for example, alkali sulfide reagents, Nokes reagents, cyanides (including ferro- and ferricyanides), and chemical oxidants, sometimes combined with thermal treatments, such as roasting or steaming.

Chemical treatments involve conditioning the concentrate with alkali and alkali earth sulfides, Nokes reagents, and/or cyanides. Chemical treatments are believed to function mainly by displacing the collector molecules on the surface of the mineral particles to produce a hydrophilic state upon the surface. Examples of chemical treatments are described in U.S. Pat. Nos. 2,492,936 to Nokes et al., and 4,549,959 to Armstrong et al.

A disadvantage with chemical treatments is that the collector used during the initial flotation to form the bulk copper/moly concentrate is still present in the concentrate after treatment, and readsorption of the collector may occur. In addition, some chemicals used as copper-sulfide depressants oxidize and lose their effectiveness over time. Another problem with chemical treatments, is the required handling of large amounts of reagents which are unsafe, toxic, and harmful to the environment. For alkali sulfides, as much as 50 pounds per ton of concentrate feed can be required. For cyanides (including ferro- and ferri-cyanides), up to 2 pounds per ton of concentrate feed are typically required.

The problem of readsorption of the collector can be largely eliminated by use of certain chemical oxidants which alters the copper-sulfide surface by destroying sulfhydryl collectors. Such a process is disclosed in U.S. Pat. No. 3,811,569 to Shirley et al. Therefore, the problem of readsorption of the collector is mostly eliminated. However, the safety, toxicity, and environmental problems persist.

The efficiency of some copper-sulfide depressants can be increased by thermal processes, such as steaming and roasting, which destroy or alter the previously added copper-sulfide collector, and change the surface of the copper and iron sulfide mineral particles. However, this efficiency is at the cost of extra process steps requiring significantly more process equipment, and increased energy costs.

Notwithstanding the measures in the prior-art processes to increase the efficiency of molybdenite recovery, the prior-art processes are inefficient. This is not only due to problems in selectively depressing the copper sulfides, but other factors contribute to the difficulty in recovering the molybdenite. For example, the type of molybdenite mineralization can contribute to the difficulty in recovery of molybdenite. Well-crystallized vein molybdenite does not cause serious problems in achieving a satisfactory recovery, but many porphyry ores contain molybdenite finely dispersed in quartz veins and molybdenite occurring as a film on other mineral phases, which can render the recovery of the molybdenite difficult. In addition, the presence of naturally floating impurities in the ore, such as talc and pyrophillite, also contribute to inefficiency in molybdenite recovery. Thus, the recovery of molybdenum from molybdenite/copper sulfide concentrates is limited, and for a commercially viable process, numerous conditioning steps and flotation stages are usually required to adequately separate and concentrate the molybdenite. Consequently, even minor improvement in molybdenum recovery would be desirable.

Ozone has been used in the art to treat sulfide ores. For example, Ishii, et al., Japanese Patent 70 16,322 (Chemical Abstract 101198h) "Flotation of Sulfide Ores," discloses the treatment of materials containing copper, lead and pyrite minerals with hydrogen peroxide or ozone oxidant. After treatment with the oxidant, the copper and lead minerals are separated from impurities such as pyrite, by floating both the copper and lead minerals into the froth product.

Natarajan and Iwasaki, in "Decomposition of Xanthane Collectors With Ozone in Alkaline Solutions," Minerals and Metallurgical Processing, November 1983, and Iwasaki and Malicsi in "Use of Ozone in the Differential Flotation of Bulk Copper-Nickel Sulfide Concentrates," Minerals and Metallurgical Processing, February 1985, disclose the use of ozone to remove residual xanthates in alkaline solutions from sulfide mineral surfaces, which enables the differential flotation of copper/nickel sulfide concentrates.

In the above references, the residual collectors are destroyed and additional collectors must subsequently be added to effect flotation.

OBJECTS OF THE INVENTION

It is, therefore, an object of the invention to provide a process for the recovery of molybdenite from materials containing copper sulfides and molybdenite, such as flotation concentrates, by depressing copper sulfide minerals.

It is also an object of the invention to provide a process for the recovery of molybdenite from such materials which requires no additional addition of collector reagents after depression of the copper sulfide minerals.

It is also an object of the invention to provide a process for the recovery of molybdenite from such materials requiring a minimum of reagents to depress the copper sulfide.

It is also an object of the invention to provide a process for the recovery of molybdenite from such materials that permanently removes collector from copper-sulfide mineral surfaces, thus minimizing problems of readsorption of the collector.

It is also an object of the invention to provide a process for the recovery of molybdenite from such materials that lowers risks to environment, safety, and health.

It is also an object of the invention to provide a process for the recovery of molybdenite from such materials that requires a minimum of additional process steps, and little increase in energy costs.

It is also an object of the invention to provide a process for the recovery of molybdenite from such materials, wherein a minimum of impurities are introduced by reagents to depress the copper sulfide.

It is also an object of the invention to provide a process for the recovery of molybdenite from such materials, which is as efficient or more efficient in the recovery of molybdenum than prior-art processes.

Other objects of the invention will become evident in the description that follows.

SUMMARY OF THE INVENTION

An embodiment of the invention is, therefore, a process for the recovery of molybdenite from a finely divided feed material containing one or more copper sulfides and molybdenite;

(a) contacting the feed material with ozone, (b) aerating an aqueous suspension of the ozone-treated feed material in the presence of a frother to float the molybdenite and create a froth containing molybdenite on the surface of the suspension, and (c) recovering the froth from the surface of the suspension to form a molybdenite concentrate product, wherein the amount of ozone in step (a) is sufficient to inhibit the flotation of copper sulfides in the feed materials upon aeration in step (b).

The process of the invention involves the recovery of molybdenite from finely divided materials containing molybdenite and copper sulfide minerals. These are typically copper/molybdenum concentrates obtained from the initial copper sulfide flotation circuit of porphyry ores. Products from other flotation circuits or stages, or similar materials from other processes, which contain copper sulfides and molybdenite are suitable as the feed material for the process of the invention.

The feed material is finely divided to free the molybdenite and copper sulfide mineral particles from surrounding gangue minerals. Typically the feed material is already finely divided from previous processes.

The feed material is conditioned by contacting the same with ozone. The ozone reacts with and removes collector reagents on the copper sulfide surfaces which may be present from the previous flotation processes. The ozone also reacts with the surfaces of the copper-sulfide mineral particles, and molybdenite particles. However, it is believed that the surface reactions for the copper sulfide mineral particles and molybdenite particles lead to different surface states. The result is a generally more hydrophilic surface for copper sulfide mineral particles as compared to molybdenite particles. The more hydrophilic nature of the copper sulfide mineral particles combined with the more hydrophobic nature of the molybdenite particles allows the separation of the molybdenite from the copper sulfides by flotation Preferably the feed, before ozone conditioning, is washed by any suitable technique, to remove excess collector reagents and the like. Washing will generally improve the molybdenite flotation response and increase the grade and recovery of the molybdenite in the concentrate product.

The feed material may be contacted with ozone by any suitable method. Preferably, the feed material is contacted by suspending the feed material in water by, for example, agitation and injecting ozone in a gas mixture into the suspension. In a typical commercial application, the process of the invention is carried out as a continuous process. In this embodiment, the process of the invention will receive the feed material as the product from a copper sulfide flotation circuit in the form of a suspension. The feed is preferably treated continuously in an ozone treatment zone wherein ozone is dispersed in the suspension as it continuously passes through the ozone treatment zone. From the ozone treatment zone, the feed material is passed to a flotation zone where the ozone treated suspension is subjected to a continuous flotation process.

Alternately, the process of the invention may be carried out as a batch process. In a batch process, the ozone conditioning can be accomplished in the flotation cell which will subsequently be used to float the molybdenite, with the ozone injected into the mixture by the same means used to aerate the suspension.

The ozone, either as a gas or in aqueous solution, may be contacted with the feed material by any suitable means, which may be separate from or incorporated into the flotation cell. For example, methods for contacting slurries with gasses, such as aerators, or by mixing the feed material, preferably dry, with an aqueous solution of ozone, preferably as a saturated solution.

The amount of ozone required depends upon the particular composition of the feed material. As the copper sulfide minerals are a principle reactant with ozone, feed materials with a high copper-sulfide content will require more ozone to obtain the desired depression of copper-sulfide minerals. In addition, if the feed contains significant amounts of other oxidizable species, the ozone consumption will be increased. Typical ozone demand required to depress chalcocite and chalcopyrite copper sulfide minerals is listed in Table I. The ozone demand was determined using the chalcocite (Concentrate A) and the chalcopyrite (Concentrate B) containing concentrates in the examples below.

TABLE I

| Ozone Addition Required To Depress Copper-Sulfide Minerals | |
|---|---|
| Major Copper-Sulfide Mineral | Ozone Demand (kg $O_3$/ton copper sulfide) |
| Chalcocite | 0.2–20. |
| Chalcopyrite | 0.2–30. |

The object is to provide sufficient ozone to depress the copper sulfides, but not substantially depress molybdenite. If a large excess of ozone is used, ozone reaction with the surfaces of the molybdenite particles may be sufficient to depress molybdenite as well as the copper sulfides. Ozone reacts relatively quickly with copper sulfide minerals to substantially remove the hydrophobicity of their surfaces. However, molybdenite in contact with ozone retains a hydrophobic surface for a much longer time. Typically, the amount of ozone required to depress molybdenite to a significant extent is at least an order of magnitude more than the amount required to selectively depress the copper sulfide minerals over the molybdenite. It is unexpected, in light of the teachings of the prior art, in particular the Ishii reference, that copper sulfide minerals can be depressed by an oxidative treatment to an extent to allow separation from molybdenite. It is also unexpected that an ozone treatment sufficient to depress copper sulfide minerals is insufficient to depress molybdenite, and that a much more extensive ozone treatment is required to also depress molybdenite. It is also unexpected that the ozone reactions at the surfaces of copper sulfide minerals and molybdenite differ to an extent to allow their separation by flotation.

In the process of the invention, the conditioning time should be sufficient to depress the copper sulfide minerals, but limited to prevent the excessive depression of molybdenite. However, after the process of the invention is carried out, it may be desirable to treat the molybdenite concentrate product further with a large amount of ozone in order to depress the molybdenite for subsequent flotation separation processes. For example, silicate impurities in the concentrate product that were floated with molybdenite, such as talc and pyrophillite, can be removed from the concentrate product by treating the concentrate product with ozone to an extent to depress the molybdenite. These silicates, which are mostly unaffected by the ozone treatment, can then be floated from the molybdenite as a froth product and the molybdenite recovered in the tails.

Typically, the amount of ozone required for the process of the invention is less than the amounts of chemical reagents required in prior-art processes. In addition, there is no toxic chemical residue or by-products. The ozone reacts to form oxide products, and any unreacted ozone is easily collected and recycled or exists in only small amounts.

After conditioning of the treated feed material with ozone, the feed material is subjected to a flotation process using conventional flotation techniques. The feed material, in the form of a suspension in water, is aerated by injecting a gas, such as air, into the suspension to form bubbles. Due to the differing surface reactions with the ozone, copper sulfides are depressed, and molybdenite is carried or floated to the top by the bubbles. The result is that the froth formed on the top of the suspension is enriched with molybdenite and reduced in copper sulfides. The froth is recovered by any suitable technique, such as skimming and/or laundering.

A frother is also added to the suspended ozone-treated feed material during the aeration. Suitable frothers are those known in the art. In general, as the hydrocarbon chain length of the frother increases, the recovery of Mo in the molybdenite concentrate increases, while the grade of Mo in the concentrate decreases. Ethyl alcohol, isopropyl alcohol, isobutyl alcohol, and methyl isobutyl carbinol (MIBC) have been found to be suitable frothers. Generally, the best overall results are achieved by using different carbon chain length frothers in different flotation stages. Where the feed material contains a relatively large proportion of copper sulfide minerals, and a relatively small amount of molybdenite, as in a rougher flotation, a relatively long carbon chain frother such as MIBC (6 carbon atoms) is usually preferred in order to maximize molybdenite recovery. Where the feed material contains a higher proportion of molybdenite, for example, for a cleaner flotation of the molybdenite concentrate product from a rougher flotation, a relatively short carbon chain length frother, such as isopropyl alcohol (3 carbon atoms) is preferred to selectively improve the molybdenite grade. Of course, one skilled in the art may combine these frothers at any stage of flotation and at different blending ratios to establish the best separation and recovery of molybdenite from a particular feed material. The total amount of frother used in the process of the invention is that normally used in the art for flotation applications, typically varying from about 0.01 to about 2 pounds frother per ton of dry feed material.

The suspension of the feed material during flotation and/or the ozone treatment may be achieved by conventional means, such as mechanical agitation, or by use of column flotation wherein particles settle through a column and requires no mechanical agitation.

Preferably, the pH of the suspension is adjusted to between about 6 to 11, more preferably between 7 and 10, for both the ozone conditioning and the flotation. Typically, the depression of copper sulfide minerals is increased as the pH rises. Molybdenite is also depressed as the pH rises, but to a much lesser extent. Accordingly, as the pH rises, the percent recovery of molybdenite decreases, but the molybdenite grade of the molybdenite concentrate increases until a pH of about 10 is reached. Above a pH of about 10, the depression of the molybdenite becomes significant enough to significantly decrease the molybdenite recovery. The pH may be adjusted by conventional means, e.g. by addition of acids, such as sulfuric acid, or by addition of bases, such as calcium hydroxide.

The pulp density, i.e. the solids content of the suspension, during aeration flotation is determined according to ordinary practice in the flotation art. Typically, the higher the pulp density, the higher the recovery of molybdenite from the feed material, and the lower the grade of the molybdenite concentrate product. Preferably, the pulp density is between about 5 and 30 wt.% solids, more preferably between about 10 and 20 wt.% solids.

Optionally, a molybdenite collector is added in a conventional amount to the ozone treated feed material during the flotation. Suitable collectors are those known in the art for molybdenite collection, such as hydrocarbon oils.

The feed material may be subjected to other conditioning steps used in the art, either before or after the ozone conditioning. Combination of the present invention with other suitable processes to depress copper sulfides is also contemplated.

The process of the invention may be accomplished as single stage process with only one ozone contact, aeration, and molybdenum concentrate recovery, or additional stages may be used to treat either or both the concentrate product and the tailings (that portion not floated into the froth). As more fully described below, this allows for a higher molybdenite recovery with a smaller ozone requirement. As another example, the concentrate product may be treated by one or more successive stages to obtain a high-purity molybdenite product. Typically, the process of the invention may be added to existing continuous flotation processes with a minimum of alteration. Usually, cells being used for prior-art process for copper sulfide depression can be readily adapted for the present process, with the addition of a commercially available ozone generator and a means to disperse the ozone-containing gas in the feed material. Thus, there is a minimum of additional energy and capital costs.

DETAILED DESCRIPTION OF THE INVENTION

Figure 1:
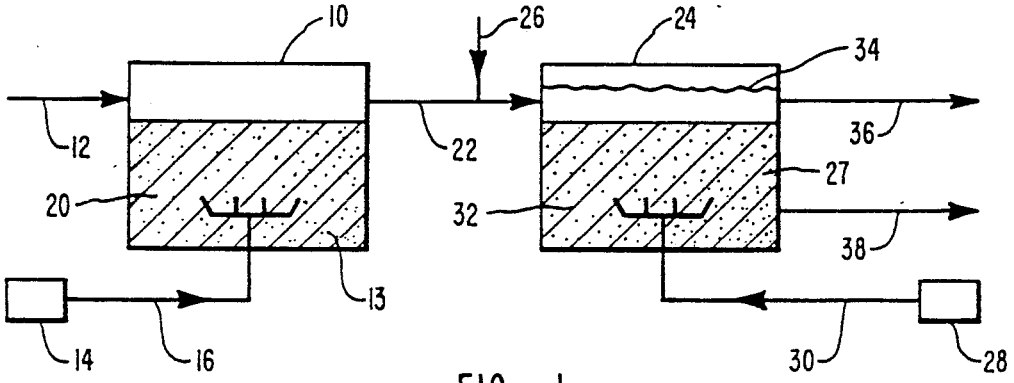
FIG. 1 is a flow diagram illustrating an embodiment of the invention.

Referring to FIG. 1 which illustrates the practice of the invention as a continuous process, a finely divided feed material containing molybdenite and copper sulfides is charged into an ozone treatment cell 10 through line 12. If required, the feed material is diluted with water to create a suspension of the feed material in water and to achieve the proper pulp density. The suspended feed material 13 is treated with ozone by distributing ozone-containing gas into the suspension from ozone generator 14 through line 16 and distributor 20. The suspended feed material which has been treated with ozone is then passed along line 22 to flotation cell 24. Before passing into the flotation cell 24, a frothing agent is introduced into the treated feed material through line 26. In the flotation cell 24, air is distributed into the ozone-treated suspension 27 from air source 28 through line 30, and distributor 32 to form bubbles in the suspension. A froth 34 containing molybdenite carried to the surface by the bubbles forms upon the surface of the ozone-treated suspension 27. The froth 34 is recovered by conventional techniques as a molybdenite rich concentrate product and is passed along line 36. The remaining unfloated copper sulfide rich portion is recovered as a tails product through line 38. Both the concentrate product and the tails product may be subjected to further processing, e.g. to further separate the molybdenite from copper sulfides, or from impurities such as talc and pyrophillite.

EXAMPLES

In the following examples, three feed materials were used. Two feed materials (Concentrate A, Concentrate B) were bulk copper/moly concentrates, i.e. the final flotation products from different copper sulfide flotation circuits, before entering the molybdenite flotation circuit. The third feed material (Concentrate C) was an intermediate product from a conventional molybdenum flotation circuit. Properties of each feed material are shown in Table II. The size distribution was determined by measuring the percent of the solid particles of the concentrate which passed through a 400 mesh (0.037 mm opening) screen.

TABLE II

| Concentrate | Major Copper Sulfide Mineral | Grade Mo (wt. %) | Grade Cu (wt. %) | Size Distribution (wt. % passing 400 mesh) |
|---|---|---|---|---|
| A | Chalcocite | 0.2–0.4 | 28–33 | 46 |
| B | Chalcopyrite | 2.5–4.1 | 32–34 | 62 |
| C | Chalcocite | ≈33 | ≈8 | — |

Unless indicated otherwise, the general experimental procedure was to (1) wash the samples, (2) treat the samples with ozone, (3) add frother and float the molybdenite by aeration, (4) recover the froth from the flotation cell as the molybdenite concentrate product, and (5) adjust and maintain pH to the desired value for steps (2) through (4).

All of the feed materials (Concentrates A, B, and C) were received as slurries containing about 20 to 35 wt.% solids. The general procedure to wash the samples was to dilute the slurries with an equivalent amount of fresh water and agitate for several minutes, followed by filtration of the slurry. The filter cake was then repulped with fresh water to create a suspension containing 20 wt.% solids. The purpose of this washing procedure was to remove residual flotation reagents contained in the as-received samples, and thus reduce the effect of these reagents in the ozone conditioning and molybdenite flotation process. In this way, a fair comparison of the effectiveness of ozone conditioning could be obtained. Unless indicated otherwise, weights of solid materials are given as the dry weight. The repulped slurry samples were then transferred into a flotation cell. The flotation cell was a four-liter Agitair ™ flotation machine manufactured by Galigher Co. The air inlet on the flotation machine was first connected to the outlets of an ozone generator (Model 03B-0, Ozone Research and Equipment Co.). The ozone, with oxygen as the parent gas, was introduced into the slurry sample through the air inlet and sparged naturally into the slurry suspension as it was stirred. The ozone was added at a rate of 0.18 g/min for the desired length of time (conditioning time). A frother was then added and flotation was conducted at a stirrer rate of 1000 rpm and an air flow rate of 6 l/min. The pulp pH was adjusted to the desired value throughout all steps by adding $H_2SO_4$ or $Ca(OH)_2$.

Unless indicated otherwise, for the single stage flotation examples (1 to 4), the addition of the frother was done in two stages. Isopropyl alcohol was added first at a concentration of 0.3 kg/ton, and flotation carried out for 4 minutes. After that, MIBC was added at a concentration of 0.01 kg/ton and the flotation carried out for an additional 4 minutes. The overall flotation time for one experiment was, therefore, 8 minutes. After flotation, both the concentrate and tailings products were filtered, dried and analyzed.

EXAMPLE 1

Figure 2:
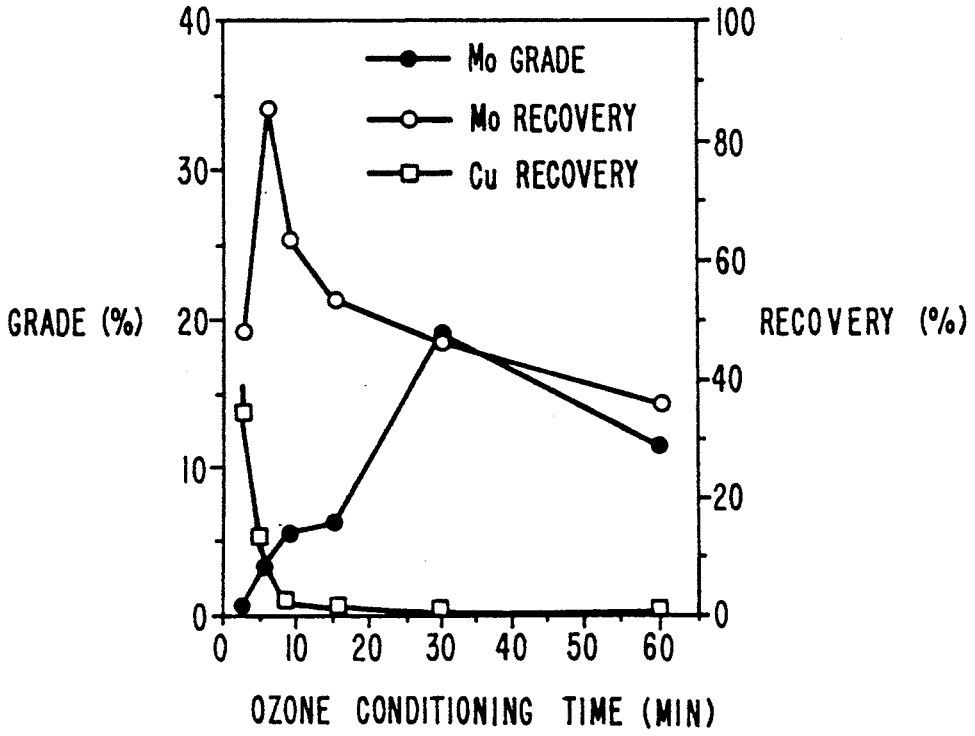
FIG. 2 is a graph showing the effect of ozone conditioning time upon Mo grade, Mo recovery, and Cu recovery for a particular feed material.

Using copper-sulfide Concentrate A as the feed material, a series of single-stage flotation tests were run as described above with differing ozone conditioning times. The pH was adjusted to about 8 for each test. Measured in each test were the Mo grade (wt.% Mo in the concentrate product) and the Mo and Cu recovery (% from the copper-sulfide/molybdenite feed material recovered in the molybdenite concentrate product). The results of the separate tests are summarized in Table III, and shown graphically in FIG. 2.

TABLE III

The Effect Of Ozone Conditioning Time On Concentrate A Flotation Response at pH 8

| Conditioning Time (min) | Mo Grade (wt. %) | Mo Recovery (%) | Cu Recovery (%) |
|---|---|---|---|
| 3 | 0.54 | 48.1 | 33.6 |
| 6 | 3.19 | 85.1 | 13.0 |
| 9 | 5.54 | 63.1 | 3.7 |
| 15 | 6.24 | 53.6 | 3.1 |
| 30 | 19.03 | 46.1 | 0.5 |
| 60 | 11.64 | 35.9 | 0.8 |

As shown by the data, the copper sulfide (which is principally Chalcocite) is quickly depressed upon contact with ozone, as is evident by the significant drop in copper recovery during the first six minutes of conditioning time. Molybdenum recovery, however, initially improves during short ozone conditioning times and then gradually decreases when the conditioning time is extended. Without being bound to any theory, it is believed the initial increase in Mo recovery is related a bubble-loading effect. Surface oxidation and depression of molybdenite by ozone conditioning is slow, whereas chalcocite particles are depressed almost instantaneously, and consequently more bubble surface is available for the attachment of molybdenite particles, resulting in an increase in Mo recovery. With extension of the conditioning time, the bubble-loading effect is not improved since the majority of the chalcocite particles have already been depressed. With long conditioning times, the surface oxidation of the molybdenite particles is increased to the point to cause a drop in Mo recovery.

EXAMPLE 2

Figure 3:
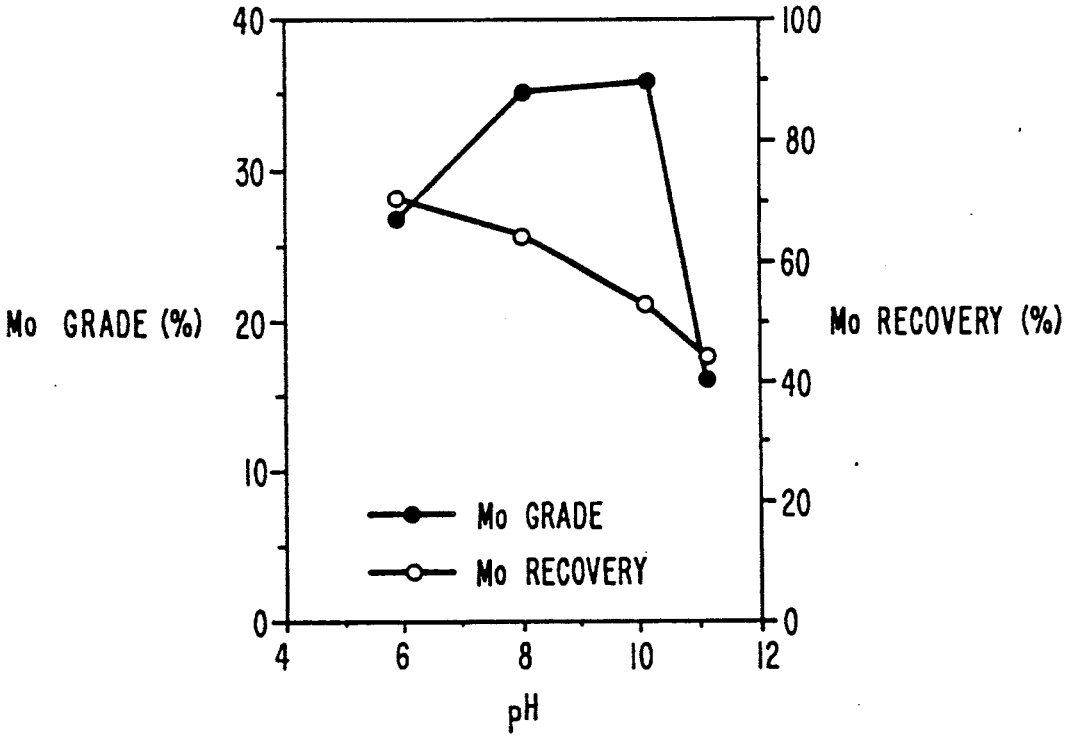
FIG. 3 is a graph showing the effect of suspension pH during the ozone conditioning and flotation processes upon Mo grade and Mo recovery for the feed material of FIG. 2.

Using Concentrate A as the feed material, a series of single-stage flotation tests were run with a fixed ozone conditioning time of 30 minutes, but at differing pH values. In each test, the Mo and Cu grade of the concentrate product and the Mo recovery were measured. The results of the separate tests are summarized in Table IV, and shown graphically in FIG. 3.

TABLE IV

The Effect of Processing pH at a Fixed Ozone Conditioning Time (30 min.) on The Flotation Response of Concentrate A

| pH | Mo Grade (wt. %) | Mo Recovery (%) |
|---|---|---|
| 5.9 | 26.77 | 70.3 |
| 8.0 | 34.47 | 65.4 |
| 10.1 | 35.86 | 53.0 |
| 11.0 | 16.07 | 44.1 |

As seen from the data, the Mo grade in the molybdenite concentrate is the highest between a pH of 7 and 10.

EXAMPLE 3

Figure 4:
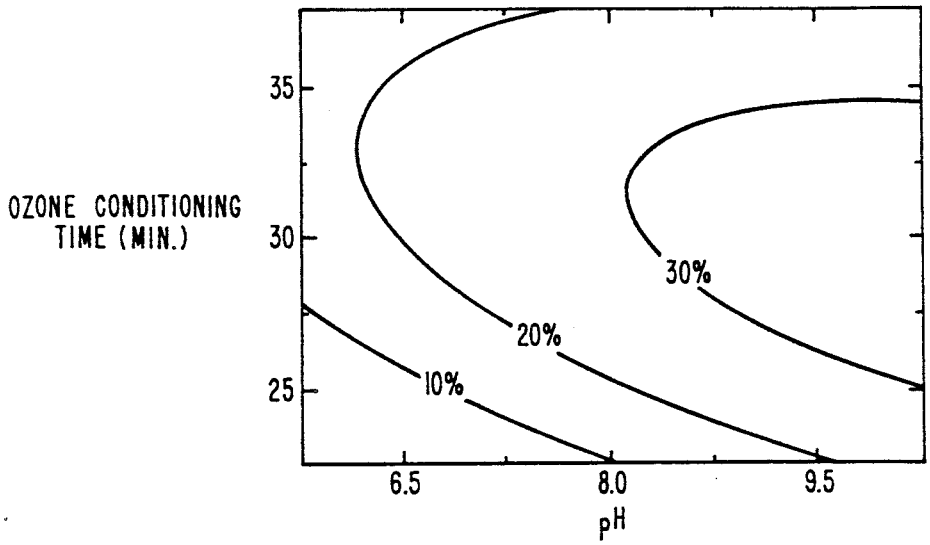
FIG. 4 is a contour plot showing Mo grade as function of ozone conditioning time and processing pH for the feed material of FIG. 2.
Figure 5:
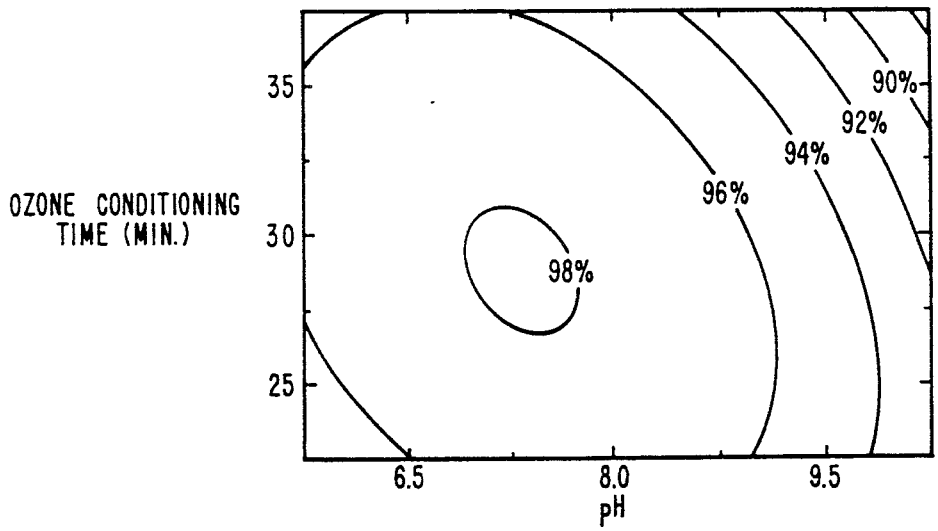
FIG. 5 is a contour plot showing Mo recovery as function of ozone conditioning time and processing pH for the feed material of FIG. 2.
Figure 6:
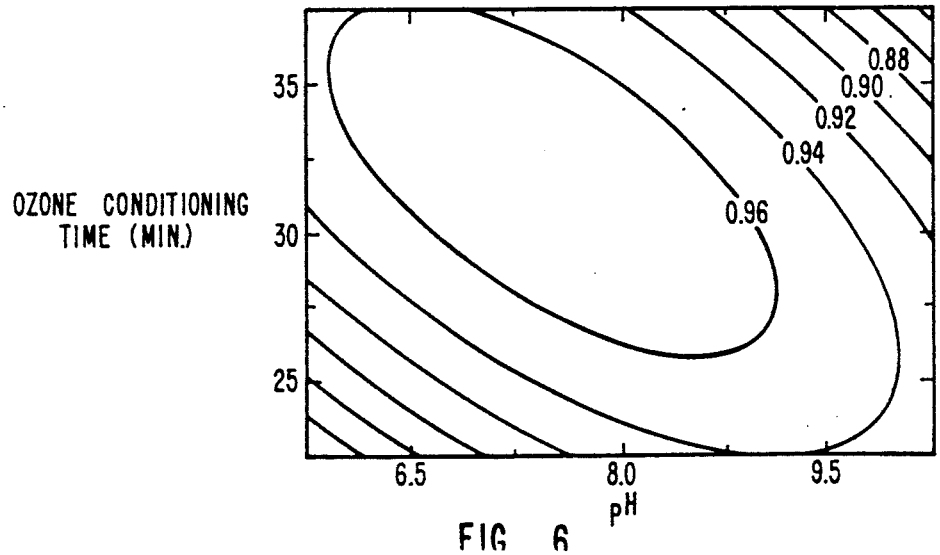
FIG. 6 is a contour plot showing the Mo coefficient of separation as function of ozone conditioning time and processing pH for the feed material of FIG. 2.

Using Concentrate A as the feed material, several single-stage tests were run varying the pH and the ozone conditioning time, in order to determine the optimal ozone conditioning time and pH for single-stage flotation for this feed material. The results of the tests are summarized in FIGS. 4, 5 and 6, which are contour plots for Mo grade of the concentrate product, Mo recovery, and coefficient of separation, respectively. The coefficient of separation is defined as the recovery of molybdenite in the froth minus the recovery of copper sulfide in the froth.

EXAMPLE 4

Figure 7:
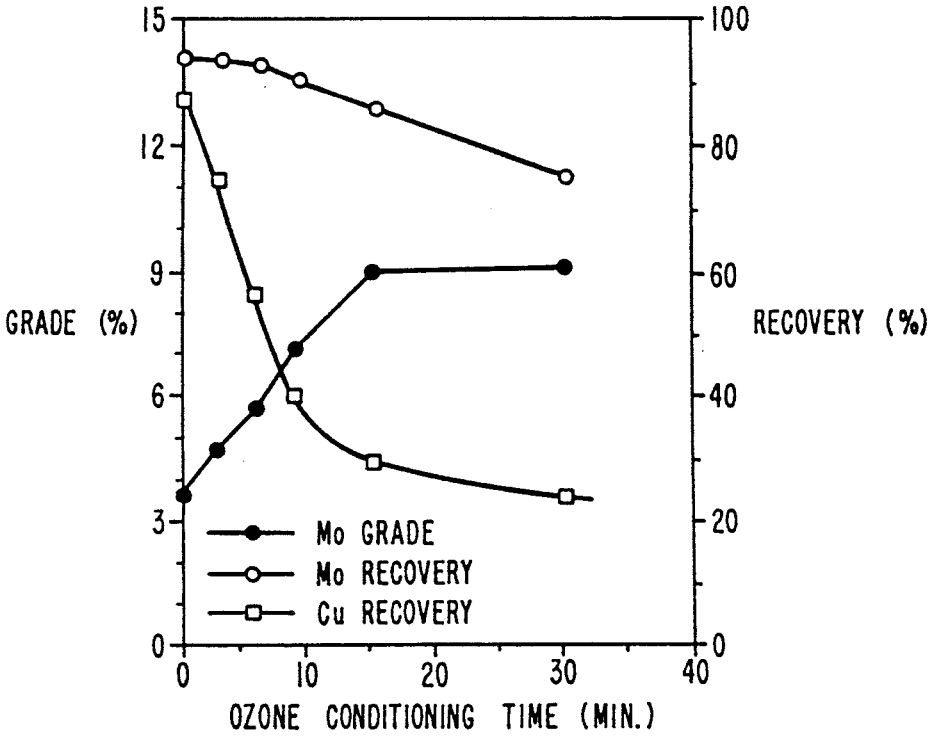
FIG. 7 is another graph showing the effect of ozone conditioning time on Mo grade, Mo recovery, and Cu recovery for another feed material than for FIG. 1.

Using Concentrate B as the feed material, a series of single-stage tests were run as described above with differing ozone conditioning times. The pH was adjusted to about pH 7 for each test. Before the ozone conditioning, each sample was first conditioned with kerosene (0.4 kg/ton). It was found with this feed material that the molybdenite and copper-sulfides, which are principally chalcopyrite, had a relatively poor floatability. The purpose of the kerosene addition was to increase the floatability of both the molybdenite and chalcopyrite before contacting with ozone. The increase in floatability also increased the selective effect of the ozone conditioning. In each test, the Mo grade and the Mo and Cu recovery were measured for the resulting molybdenite concentrate product. The results are summarized in Table V, and shown graphically in FIG. 7.

TABLE V

The Effect Of Ozone Conditioning Time On The Flotation Response of Concentrate B at pH 7

| Conditioning Time (min) | Mo Grade (wt. %) | Mo Recovery (%) | Cu Recovery (%) |
|---|---|---|---|
| 0 | 3.58 | 93.8 | 87.4 |
| 3 | 4.72 | 93.7 | 74.6 |
| 6 | 5.67 | 92.9 | 56.5 |
| 9 | 7.14 | 90.3 | 39.9 |
| 15 | 8.98 | 86.2 | 29.3 |
| 30 | 9.10 | 75.3 | 24.3 |

As shown by the data, the results were similar to those in Example 1. The copper sulfide in this example (which is principally Chalcopyrite) is also quickly depressed upon contact with ozone, as is evident by the significant drop in copper recovery during the first ten minutes of conditioning.

EXAMPLE 5

Several stages of batch flotation tests were run in a manner to simulate a continuous multistage flotation process. Typically, the ozone-conditioning time to achieve a satisfactory separation in a single-stage batch or continuous process is too high to be economical. This example illustrates the use of a plurality of stages with short ozone conditioning times, resulting in a lower ozone consumption.

Using Concentrate A, three sets of flotation tests were conducted. First, a rougher flotation was conducted using Concentrate A as the feed material. The rougher feed material was conditioned with ozone, as previously described, for 2 minutes. MIBC was then added in an amount of 0.01 kg/ton and flotation carried out as described above. This rougher flotation was repeated to accumulate sufficient product concentrate for a subsequent cleaner flotation. An average Mo recovery of 89.5% was obtained during the rougher flotation.

The product concentrates from the rougher flotation were repulped and mixed together. A cleaner flotation was conducted using the repulped concentrates as the feed material for the cleaner flotation. The ozone contacting and flotation was conducted as previously described, except a 2-liter flotation cell was used due to the limited amount of feed material available from the rougher flotation. The feed material for the cleaner flotation was contacted for 3 minutes with ozone, and then 0.1 kg/ton isopropyl alcohol was added before the flotation. The product concentrate from the cleaner flotation contained 26.0 wt.% Mo with a 92.2% Mo recovery from the cleaner flotation feed. This corresponds to a Mo recovery of 82% from the original feed material (Concentrate A) to the rougher flotation.

The tailings rejected from the rougher flotation were also used as feed in a scavenger step by conditioning the tailings with ozone for 1 minute, and conducting a scavenger flotation. No additional frothing agent was required as sufficient frothing agent was in the scavenger feed material from the previous rougher flotation. The product concentrate of the scavenger flotation contained 89.9% of the Mo from the rougher tailings at a Mo grade of 1.64 wt.%.

Figure 8:
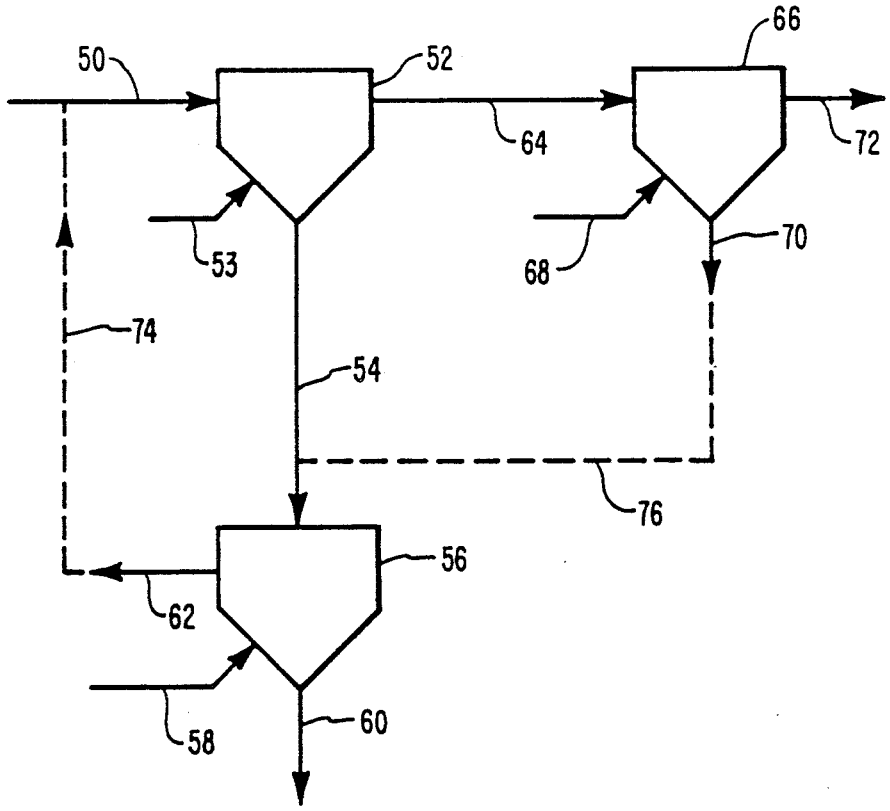
FIG. 8 is a flow sheet illustrating an embodiment of the invention with multiple flotation cells.

Referring to FIG. 8, which is a flow-sheet of the above simulated procedure, Concentrate A is directed along line 50 into rougher flotation cell 52. Ozone is introduced into the rougher flotation cell through line 53 to contact the feed with ozone, then air is introduced through line 53 and the flotation carried out in rougher cell 52. The froth from rougher cell 52 is recovered and directed along line 54 as rougher concentrate product. The rougher concentrate product is directed along line 54 and introduced into cleaner flotation cell 56. Ozone is directed through line 58 to contact the cleaner feed with ozone, then air is directed through line 58 and flotation is carried out in cleaner cell 56. The products of the cleaner flotation, the cleaner concentrate and cleaner tailing, are directed along lines 60 and 62, respectively. The tailings from the rougher flotation cell are directed along line 64 and into scavenger flotation cell 66. Ozone is directed along line 68 to contact the scavenger feed with ozone and then air is directed along line 68 and flotation is carried out in scavenger cell 66. The products of the scavenger flotation, the scavenger concentrate product and scavenger tailings, are directed along lines 70 and 72, respectively. It is understood that in a continuous process on a plant scale, the ozone treatment and flotation would preferably occur in separate cells with separate lines for the ozone and the air introduction, as illustrated in the single-stage process of FIG. 1.

Below in Table VI is shown the mass balances for the process streams, with the Mo grade and Mo distribution for each stream. The stream numbers refer to those in FIG. 7. The overall ozone consumption was 0.72 kg ozone/ton Concentrate A feed, or 0.29 kg ozone/kg of Mo recovered.

TABLE VI

| | Mass Balance | |
|---|---|---|
| Stream No. | Mo Grade (%) | Mo Distribution. (%) |
| 50 | 0.25 | 100.0 |
| 54 | 2.24 | 89.5 |
| 64 | 0.03 | 10.5 |
| 60 | 26.00 | 82.5 |
| 62 | 0.23 | 7.0 |
| 70 | 1.64 | 9.4 |
| 72 | 0.003 | 1.1 |

The dotted lines 74,76 represent redirection of the cleaner tailings to the feed of rougher flotation, and the scavenger concentrate to the feed of the cleaner flotation, respectively. This would be appropriate for a continuous process in a plant operation, but was not simulated in this example. With such a scheme, an overall molybdenum recovery of 98.9% from the feed concentrate would be the maximum recovery expected in the cleaner concentrate product with a cleaner concentrate product grade of 26.0 wt.% Mo. The expected reagent consumption would be 0.01 kg/ton MIBC in the rougher flotation, and 0.1 kg/ton isopropyl alcohol in the cleaner flotation.

Optionally, the cleaner concentrate may be subjected to one or more additional stages comprising an ozone conditioning (e.g. about 1 minute) then a recleaner flotation step. It is thereby possible to achieve a high-purity molybdenite concentrate, with a negligible copper content. Recleaner flotation steps are illustrated in Example 6.

EXAMPLE 6

This example illustrates the utilization of ozone conditioning to produce a high quality molybdenite product from Concentrate C. The two stages of flotation, which were used for this feed material, correspond to recleaner flotation of a product similar to the cleaner concentrate product in Example 5. In the first stage of flotation, the suspended solids concentration was set at 10 wt.% solids. The ozone conditioning time was 3 minutes, 0.1 kg/ton isopropanol and 0.01 kg/ton MIBC were added, and the flotation was done in a 4 liter Galigher Cell. This flotation yielded a froth product containing 46.47 wt.%Mo and 2.74 wt.% Cu, at a recovery of 23.6% for Cu and 79.7% for Mo.

The first recleaner process was repeated for several times until enough froth product was collected for another stage of recleaner flotation. In this second stage of recleaner flotation, the fourth product was repulped, given an additional 1 minute ozone conditioning time, and then subjected to flotation. Samples were taken at various times during the second stage flotation to show the relationship between Mo grade, Mo recovery, Cu grade, and Cu for this two-stage recleaner flotation was 2.1 kg $O_3$/ton of Concentrate C. The results are listed in Table VII. As shown in the table, the recleaner stages can produce a copper-free molybdenite concentrate at 34.4% recovery. Even at a Mo recovery of 84.3, the Cu content in the froth product is only 0.34% Cu.

TABLE VII

The Effectiveness of Ozone Conditioning in Recleaner Flotation For Concentrate C.

| | Mo Cumulative Recovery (%) | Mo Cumulative Grade (wt. %) | Cu Cumulative Recovery (%) | Cu Cumulative Grade (wt. %) |
|---|---|---|---|---|
| First Stage Recleaner Flotation | 79.7 | 46.47 | 23.6 | 2.74 |
| Second Stage Recleaner Flotation | 16.7 | 50.60 | 0 | 0 |
| | 34.4 | 49.45 | 0 | 0 |
| | 48.6 | 48.83 | 1.0 | 0.06 |
| | 69.5 | 47.96 | 4.4 | 0.17 |
| | 84.3 | 47.47 | 10.8 | 0.34 |

EXAMPLE 7

Figure 9:
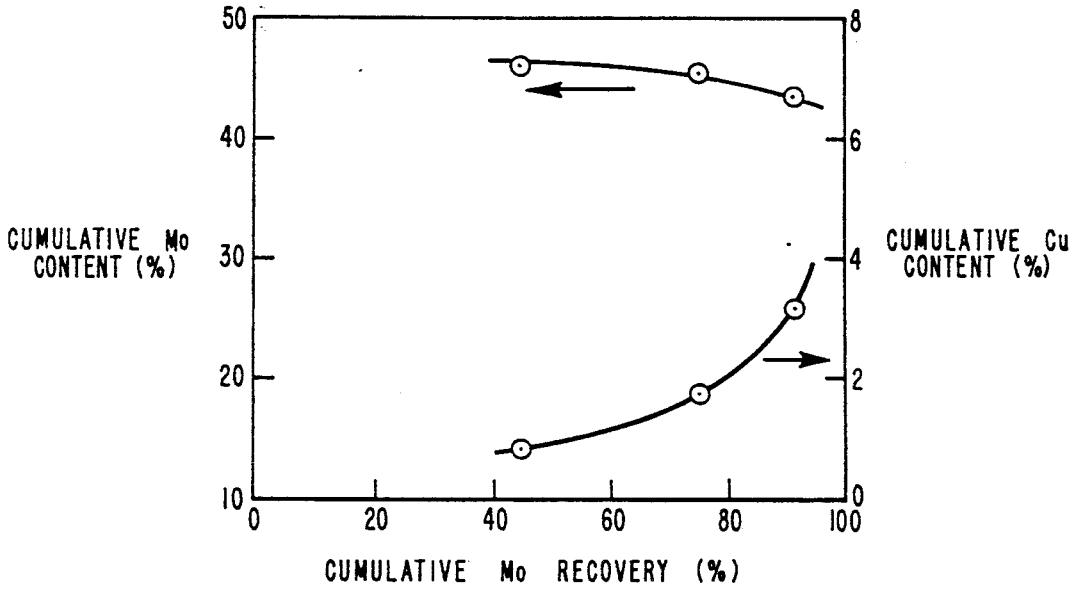
FIG. 9 is a graph showing cumulative Cu content and cumulative Mo content as a function of cumulative Mo recovery for an alternate embodiment of the invention using ozone saturated water.
Figure 10:
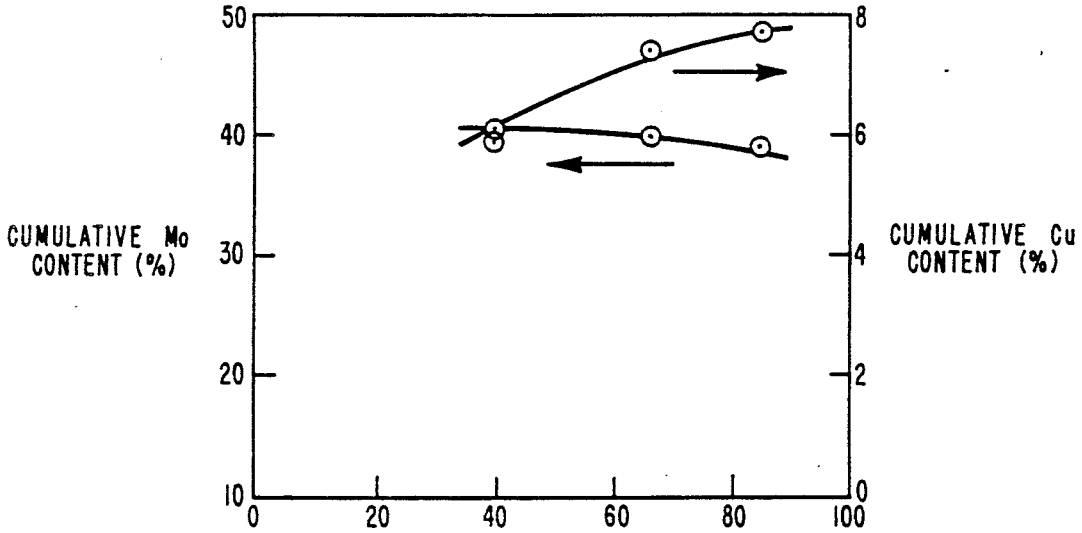
FIG. 10 is a graph showing cumulative Cu content and cumulative Mo content as a function of cumulative Mo recovery for a blank control test.

This example illustrates ozone conditioning by the use of ozone-saturated water. In this experiment, 150 grams of dry feed material (Concentrate C) were slurried in 2 liters of ozone-saturated water, which corresponds to an ozone dosage of 0.09 kg/ton of the feed material. After 8 hours of conditioning, the slurry was transferred into a 2 liter flotation cell, and the flotation carried out. Several froth products were collected and analyzed as the flotation process progressed so that the relationship between cumulative Mo recovery versus cumulative Mo and Cu grade could be obtained. The results are summarized in FIG. 9. As a control, the experiment was repeated with a water blank instead of ozone saturated water. The results are shown in FIG. 10. In Table VIII, the data for Figures 9 and 10 are tabulated.

TABLE VIII

Effect of Ozone Saturated Water in the Selective Flotation of Molybdenite from Concentrate C

| | Molybdenum Cumulative Recovery (%) | Molybdenum Cumulative Grade (wt. %) | Copper Cumulative Grade (wt. %) |
|---|---|---|---|
| Ozone Saturated Water | 44.9 | 46.56 | 0.98 |
| | 75.2 | 44.49 | 1.89 |
| | 91.2 | 42.93 | 3.10 |
| Blank Control | 40.6 | 42.17 | 6.13 |
| | 66.2 | 40.89 | 7.89 |
| | 85.2 | 40.03 | 8.00 |

The ozone consumption, calculated from experimental conditions and the solubility of ozone, was 0.09 kg/ton feed.

Feed materials, such as Concentrate A, which contain a large amount of copper-sulfide minerals, require a higher ozone consumption and the amount of ozone in saturated water may not be sufficient for the depression of the copper-sulfide minerals to take place.

EXAMPLE 8

This example illustrates the importance of the frother's alkyl group on the selective flotation of molybdenite from copper sulfide minerals with ozone conditioning. Concentrate A was used as a feed material in tests with four different frothers of varying chain length (ethyl alcohol, ($C_2$), isopropyl alcohol, ($C_3$), isobutyl alcohol, ($C_4$), and MIBC, ($C_6$). In these tests, the feed material was conditioned at 20% solids with ozone for 30 minutes. After conditioning, 0.3 kg/ton of each frother was added and flotation carried out. The pulp pH during the entire process was controlled at pH 11. After flotation, the froth product and the remaining tailings were filtered, dried and analyzed. The experimental results are given in Table IX and FIG. 11, in which froth product concentrate grade and flotation recovery are plotted versus the number of carbon atoms in the alkyl group of the frother used.

TABLE IX

Effect of Frother Chain Length on Mo Grade and Recovery For Single Stage Flotation of Concentrate A

| C atoms in Alkyl Group | Mo Grade (wt. %) | Mo Recovery (%) |
|---|---|---|
| 2 | 37.42 | 54.3 |
| 3 | 34.37 | 65.4 |
| 4 | 35.78 | 72.6 |
| 6 | 33.42 | 83.3 |

Figure 11:
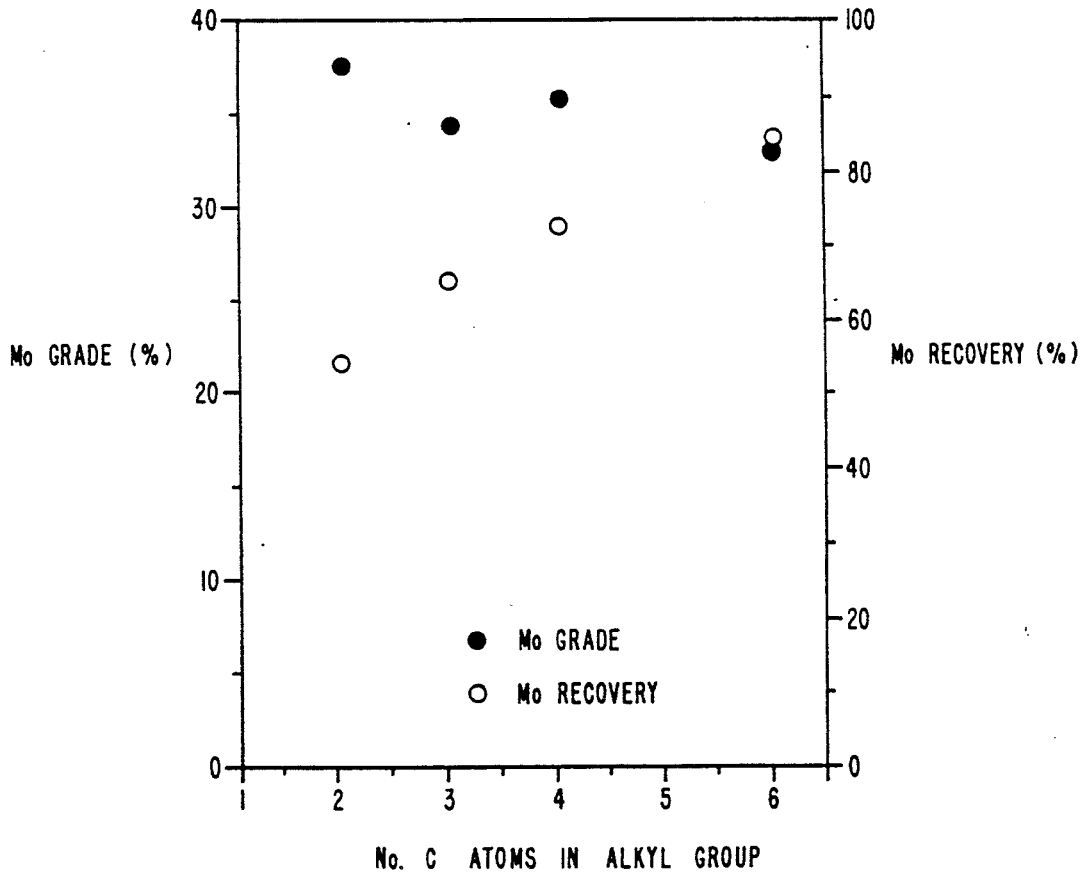
FIG. 11 is a graph showing the effect of the frother chain length on Mo grade and Mo recovery.

As can be seen from FIG. 11 and Table IX, with an increase in chain length, Mo recovery increased while the grade of the concentrate decreased. With this in view, one skilled in the art may select a short chain frother for the ozone conditioning/flotation process in order to obtain a froth product with higher Mo grade, such as would be desirable as a feed material in a recleaner flotation, as described, for example, in Example 6. On the other hand, a long chain frother would be selected to obtain a higher Mo recovery such as would be desired in the rougher flotation described in Example 5. Accordingly, one skilled in the art may use a combination of both short chain and long chain frothers at different ratios during selective molybdenite flotation from copper minerals in order to achieve both high grade and recovery of molybdenite from the feed material with minimum ozone consumption.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A process for the recovery of molybdenite from a finely divided feed material containing one or more copper sulfides and molybdenite comprising;

(a) contacting the feed material with ozone, (b) aerating an aqueous suspension of the ozone-treated feed material in the presence of a frother to float molybdenite and create a froth containing molybdenite on the surface of the suspension, and (c) recovering the froth from the surface of the suspension to form a molybdenite concentrate product, wherein the amount of ozone in step (a) is sufficient to inhibit the flotation of copper sulfides in the feed material upon aeration in step (b).

2. The process of claim 1, wherein the pH for step (b) is between 6 and 11.

3. The process of claim 1, wherein the pH for step (b) is between 7 and 10.

4. The process of claim 1, wherein the feed material is contacted with ozone in step (a) by distributing an ozone-containing gas through an aqueous suspension of the feed material.

5. The process of claim I, wherein the feed material is contacted with ozone in step (a) by contacting the feed material with water saturated with ozone.

6. The process of claim 1, wherein the frother has a carbon-chain length between 2 and 6.

7. The process of claim 1, wherein the frother is methyl isobutyl carbinol.

8. The process of claim 1, wherein the frother is isobutyl alcohol.

9. The process of claim 1, wherein the frother is isopropyl alcohol.

10. The process of claim 1, wherein the frother is ethanol.

11. The process of claim 1, wherein the feed material is washed before contacted with ozone in step (a).

12. The process of claim 1, wherein the steps (a) and (b) are conducted in one vessel as a batch process.

13. The process of claim 1, wherein the steps (a) and (b) are conducted in separate vessels as a continuous process.

14. The process of claim 1, additionally comprising treatment of the molybdenite concentrate product to further concentrate the molybdenite.

15. The process of claim 1 additionally comprising;

(d) contacting the molybdenite concentrate product from step (c) with ozone, (e) aerating an aqueous suspension of the ozone-treated molybdenite concentrate product in the presence of a frother to float molybdenite and create a froth containing molybdenite on the surface of the suspension, and (f) recovering the froth from the surface of the suspension to form a molybdenite cleaner product, wherein the amount of ozone in step (d) is sufficient to inhibit the flotation of copper sulfides upon aeration in step (e).

16. The process of claim 15 additionally comprising;

(g) contacting the molybdenite cleaner product from step (f) with ozone, (h) aerating an aqueous suspension of the ozone-treated molybdenite cleaner product in the presence of a frother to float molybdenite and create a froth containing molybdenite on the surface of the suspension, and (i) recovering the froth from the surface of the suspension to form a molybdenite recleaner product, wherein the amount of ozone in step (g) is sufficient to inhibit the flotation of copper sulfides upon aeration in step (h).

17. The process of claim 1, additionally comprising the treatment of the tails, the unfloated portion remaining after recovery of the molybdenite concentrate product in step (c), to recover molybdenite in the tails.

18. The process of claim 1 additionally comprising:

(d) recovering the unfloated portion remaining after recovery of the molybdenite concentrate product from in step (c) to form tails, (e) contacting the tails from step (d) with ozone, (f) aerating an aqueous suspension of the ozone-treated tails in the presence of a frother to float molybdenite and create a froth containing molybdenite on the surface of the suspension, and (g) recovering the froth from the surface of the suspension to form a molybdenite scavenger product, wherein the amount of ozone in step (e) is sufficient to inhibit the flotation of copper sulfides upon aeration in step (f).

19. The process of claim 1 wherein the feed material contains a silicate chosen form the group consisting of talc and pyrophillite, and said process additionally comprises;

(d) contacting the molybdenite concentrate product of step (c) with ozone, (e) aerating an aqueous suspension of the ozone-treated molybdenite concentrate in the presence of a frother to float the silicate and create a froth containing silicate on the surface of the suspension, and (f) recovering the portion of the molybdenite concentrate product not in the froth on the surface of the suspension to form an enriched molybdenite product, wherein the amount of ozone in step (d) is sufficient to inhibit the flotation of molybdenite upon aeration in step (e) such that the froth is enriched in silicate.

* * * * *